United States Patent [19]

den Hollander

[11] 4,079,295

[45] Mar. 14, 1978

[54] POWER SUPPLY ARRANGEMENT WITH MINIMUM INTERACTION BETWEEN PLURAL LOADS

[75] Inventor: Willem den Hollander, Schlieren, Switzerland

[73] Assignee: RCA Corporation, New York, N.Y.

[21] Appl. No.: 728,630

[22] Filed: Oct. 1, 1976

[30] Foreign Application Priority Data

Nov. 7, 1975 United Kingdom ..... 46178/75

[51] Int. Cl.[2] ..... H01J 29/70

[52] U.S. Cl. ..... 315/411; 363/20

[58] Field of Search ..... 315/411; 358/190; 321/2 HF; 336/170, 180, 182; 323/48, 60

[56] References Cited

U.S. PATENT DOCUMENTS

| | | | |
|---|---|---|---|
| 3,818,314 | 6/1974 | Bishop et al. | 323/60 |
| 3,891,892 | 6/1975 | Bohringer | 315/411 |

*Primary Examiner*—Maynard R. Wilbur
*Assistant Examiner*—T. M. Blum
*Attorney, Agent, or Firm*—Eugene M. Whitacre; Paul J. Rasmussen

[57] ABSTRACT

A source of alternating current in a power supply and deflection system of a television receiver is coupled to a primary winding of a transformer, a relatively closely coupled secondary winding of which provides a voltage which may be rectified for providing operating voltage for another portion of the receiver such as the vertical deflection system. Yet another portion of the receiver, such as the audio section, is energized by voltage derived from a winding so disposed around the transformer as to be energized by leakage flux from the transformer for substantially reducing the effects of variations of the audio loading on the deflection systems.

6 Claims, 4 Drawing Figures

POWER SUPPLY ARRANGEMENT WITH MINIMUM INTERACTION BETWEEN PLURAL LOADS

BACKGROUND OF THE INVENTION

This invention relates to an improved power supply for a television receiver.

Often it is desirable to derive operating voltages for a television receiver from alternating current produced in the horizontal deflection system. Such current may be obtained from secondary windings of a transformer which forms the coupling between a switched mode power supply, operating at the horizontal scanning frequency, or some other frequency and the deflection system, such as described in copending United States application Ser. No. 607,512, entitled "Synchronized And Regulated Power Supply," or from a winding of the horizontal output transformer. Such arrangements eliminate the need for a separate mains transformer and the relatively high frequency alternating current may be smoothed by smaller capacitors than otherwise required for the mains current frequency.

Under some circumstances the variable loading of the audio circuit on the horizontal deflection system causes the width of the picture to be varied at the audio rate. Similarly if the vertical deflection system operating voltage is derived from the horizontal system the picture height as well may be modulated at the audio rate. Of the known techniques for reducing the effects of audio modulation such as the use of a separate mains transformer for the audio power supply, use of a conventional shunt stabilizer coupled between the secondary winding and the audio circuit, and, the use of very careful circuit design with highly sophisticated smoothing networks, the first is very expensive, the second calls for a high power consumption and the third requires complex design and is not always possible.

In accordance with a preferred embodiment of the invention, a transformer includes a core providing a main flux path, a primary winding and at least first and second windings. The primary winding is coupled to a source of alternating current in a power supply and deflection system and is wound around the core for establishing flux therein. The first winding is closely wound around the core to have a voltage induced therein by the main flux of the core and is coupled to provide operating voltage to a first load. The second winding is loosely wound about the core without encircling any leg thereof so as to have a voltage induced therein primarily by the leakage flux of the transformer, the second winding being coupled to provide operating voltage for a second load such that variations in the second load current have substantially no effect on the deflection system and first load voltages.

DESCRIPTION OF THE INVENTION

Figure 1:
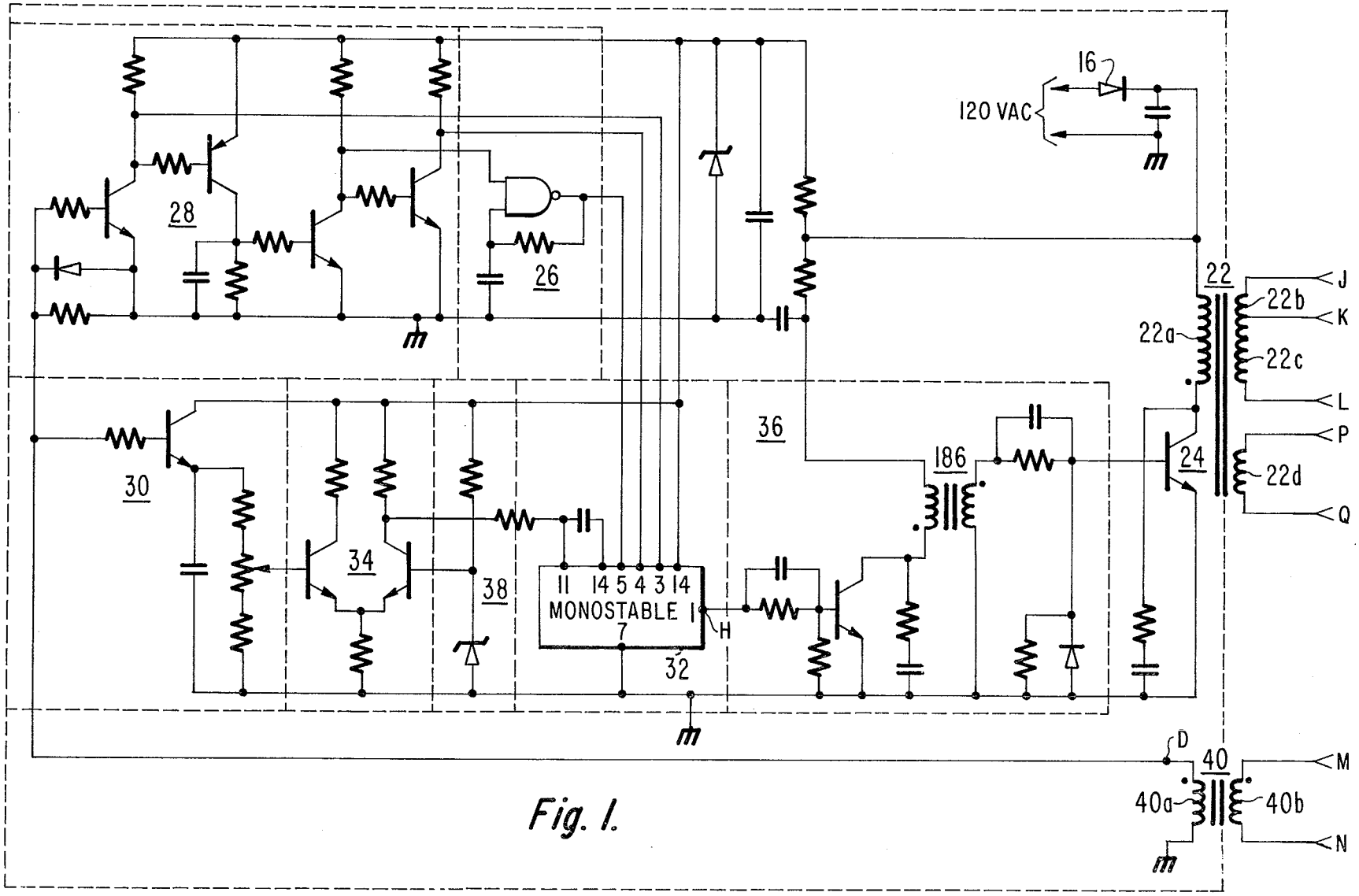
FIGS. 1 and 2 combined are a schematic circuit diagram of a horizontal deflection and power supply system including a transformer arrangement for a power supply according to the invention.
Figure 2:
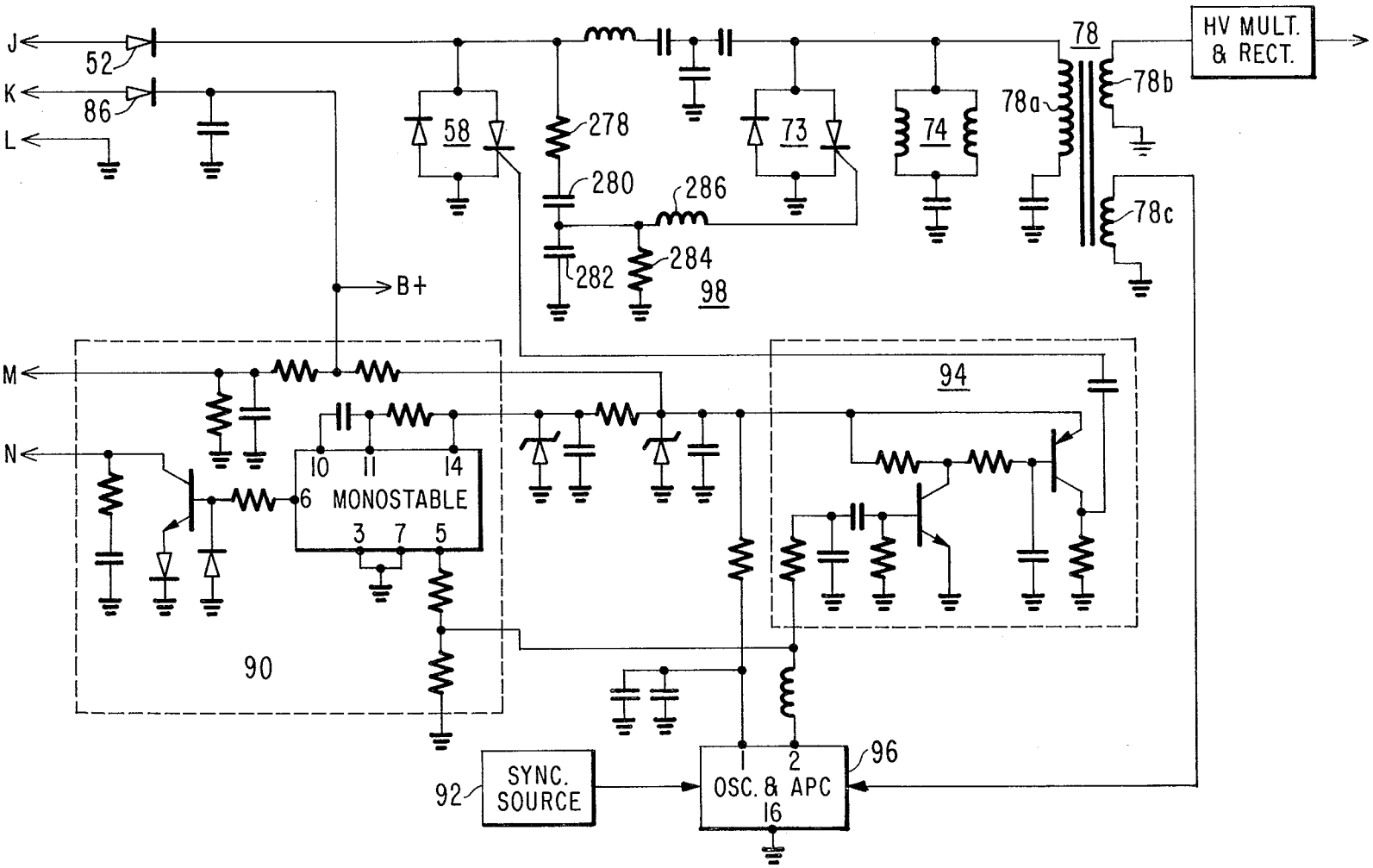

In FIGS. 1 and 2 a switched-mode power supply provides regulated voltage for a horizontal deflection system and also serves to provide isolation from the alternating current line between the primary and secondary windings of the switching transformer. A detailed description of such an arrangement is given in the aforementioned application, but a brief description follows to illustrate a suitable environment for the present invention.

In FIG. 1 the line voltage is rectified by rectifier 16 and coupled through a primary winding **22*a* of a switching transformer 22 to a switching transistor 124 of a switching output circuit 36 operating at the horizontal deflection frequency. Secondary windings 22*b*, 22*c* and 22*d* are thereby energized and couple the alternating current switching voltage to the corresponding terminals of FIGS. 2 and 3**.

In FIG. 2, the alternating current voltage at terminal J is rectified by a rectifier 52 and provides operating voltage for a horizontal deflection system 98. This deflection system is of the dual bidirectional conducting switch type comprising a commutating switch 58 and a trace switch 73. During the commutation portion of each deflection cycle, energy is coupled through a commutating network 62 to replenish losses incurred in the circuit during the trace portion. During the trace portion, trace switch 73 operates to couple deflection windings 74 across a capacitor 76 for causing alternating current sawtooth scanning current in windings 74. During the retrace portion of each deflection cycle, occurring within the commutation period, retrace pulse energy is coupled through transformer 78 for providing a high level picture tube voltage from a high voltage multiplier and rectifier assembly 82 and to provide auxiliary retrace pulses at winding **78*c* of the transformer. The commutating switch 58 is energized by pulses obtained from a pulse shaping network 94 and the trace switch 73 is controlled by a waveform derived across the commutating switch 58 and suitably formed by elements 278, 280, 282, 286 and 284**. Details of such a deflection system are given in U.S. Pat. No. 3,452,244.

The power supply in this embodiment is operated at the horizontal deflection rate, although other frequencies could be utilized, and along with the deflection system, is synchronized by a source of synchronizing signals 92 coupled to an input terminal of an oscillator and automatic frequency control circuit 96. The pulses obtained from transformer winding **78*c* are coupled to the oscillator to synchronize its operation in relation to the pulses from sync source 92. Output pulses from oscillator 16 drive the pulse shaper 94 and a modulator stage 90 for producing at terminals M and N a pulse for synchronizing the switching regulator and which pulse contains amplitude information representative of any direct current voltage variations in the B+ supply obtained from rectifier 86. The pulses at terminals M and N are coupled through a small isolating transformer 40 in FIG. 1 for further processing by various pulse shaping and detector circuits 30, 34, 28, 26 and 38 for providing a duty cycle modulated control signal at terminal H of a monostable multivibrator 32 which in turn controls the output switching stage 36**.

Figure 4:
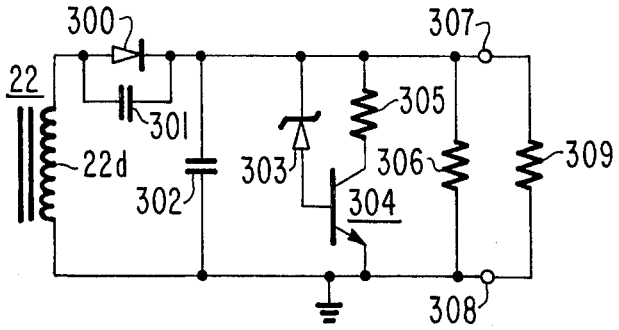
FIG. 4 is a circuit diagram of a shunt regulator suitable for use with the transformer of FIG. 3.

The direct voltage obtained from the B+ terminal following rectifier 86 in FIG. 2 may also be utilized for supplying operating voltage to the vertical deflection circuit of the television receiver. The voltage across winding 22d is utilized in FIG. 4 for supplying a voltage for use by the audio section of the television receiver, the load of which is represented by a resistor 309 coupled across terminals 307 and 308. The rectifier 300 provides half wave rectified current which is smoothed by filter capacitor 302. Zener diode 303, transistor 304 and resistors 305 and 306 comprise a relatively simple shunt regulator for stabilizing the direct current voltage appearing across terminals 307 and 308 as the loading by the audio circuit, illustrated here by resistor 309, varies. Because the winding **22*d* is so loosely coupled to transformer 22 even though the primary and secondary voltages of windings 22*a*, *b* and *c* are regulated against load variations, the voltage across winding 22*d* is not. It is noted that the voltage obtained from winding 22*d* will stay constant as long as the current taken from this winding is constant and the rest of the regulator is operating properly as described. In the circuit of FIG. 4, as the loading by resistor 309 increases, transistor 304 conducts less tending to raise the voltage across terminals 307 and 308 to keep the voltage constant. Conversely, as the loading by resistor 309 decreases, transistor 304 conducts more heavily tending to decrease the voltage across terminals 307 and 308 to maintain the voltage constant. Series connected resistor 305 and transistor 304 thereby constitute a shunt regulator. Resistor 306 protects the shunt regulator for too high a dissipation when the load 309 should be removed. Capacitor 301 in parallel with rectifier 300** serves to reduce any ringing or oscillations in the circuit.

Figure 3:
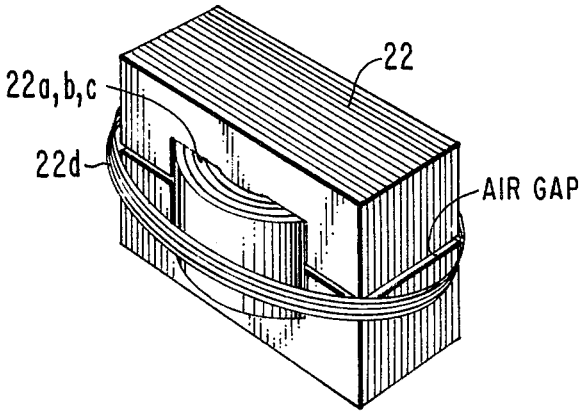
FIG. 3 is a perspective view of a transformer suitable for use in the system of FIGS. 1 and 2.

FIG. 3 illustrates a transformer suitable for use with the invention for reducing the undesirable loading problems described above. The transformer comprises a core 22 made up of two "E" sections with air gaps **22*e* as shown between the two halves. Primary and secondary windings 22*a*, *b* and *c* such as illustrated schematically in FIG. 1 are wound around the center leg of the transformer. A relatively loosely coupled winding 22*d* is wound around the transformer so as to be energized by the leakage flux of the transformer. In the FIG. 3 embodiment, the instantaneous flux which for example, is traversing the center leg of the core in an upward direction and divides and traverses the two outside core legs in a downward direction would induce voltages in winding 22*d* which in the absence of leakage flux would cancel. However, because there is leakage flux primarily in the region of the air gaps in the outer two core legs unequal amounts of flux traverse the turns of winding 22*d* and the difference in flux, which is equal to the leakage flux, induces the voltage in winding 22*d* which is rectified by rectifier 300 in FIG. 4. Because of this utilization of leakage flux for inducing the voltage which is rectified to energize the audio circuits, variations in the audio load have little effect on the voltages induced by the main core flux in windings 22*a*, 22*b* and 22*c***. Additionally, the utilization of leakage flux in this manner reduces the total power consumption as measured at the input line voltage terminals because the otherwise wasted leakage flux is efficiently utilized.

Although winding **22*d* is shown as being wound around the switched mode power supply transformer 22** it is to be understood that it may also be wound in a similar manner around another transformer such as a horizontal deflection output transformer and the same advantages would be realized.

What is claimed is:

1. A power supply arrangement with minimum interaction between plural loads, comprising:

a deflection and power supply system providing a source of alternating current;

a transformer including a core providing a main flux path, a primary winding and second and third windings, said primary winding wound on said core and coupled to said source of alternating current for establishing magnetic flux in said core;

a first load;

said second winding being closely coupled to said core for having a first voltage induced therein by said flux in said core, said winding being coupled to said first load for supplying voltage thereto;

a second load being subject to variations;

said third winding being loosely wound about said core without encircling any leg of said core for having a second voltage induced therein by leakage flux and coupled to said second load such that any variations in said second load have substantially no effect on said first voltage and said source of alternating current.

2. A power supply arrangement according to claim 1 wherein said core comprises a two-window core.

3. A power supply arrangement according to claim 2 wherein said primary and second windings are wound to encircle the center leg of said core.

4. A power supply arrangement according to claim 3 wherein said third winding is wound about the outside two legs of said two-window core.

5. A power supply arrangement according to claim 1 wherein said transformer couples alternating current energy at said deflection rate to rectifying means in said deflection system for providing operating voltage thereto.

6. A power supply arrangement according to claim 1 wherein said transformer is the output transformer of said deflection system.

* * * * *